US007984704B1

(12) United States Patent
Tier

(10) Patent No.: US 7,984,704 B1
(45) Date of Patent: Jul. 26, 2011

(54) CRANKCASE SIDEWALL FOR SUPPORTING A CRANKSHAFT

(76) Inventor: David H. Tier, Middlebury, VT (US)

( * ) Notice: Subject to any disclaimer, the term of this patent is extended or adjusted under 35 U.S.C. 154(b) by 0 days.

(21) Appl. No.: 12/764,358

(22) Filed: Apr. 21, 2010

(51) Int. Cl.
*F02B 75/22* (2006.01)
*F02F 1/10* (2006.01)
*F02F 7/00* (2006.01)

(52) U.S. Cl. ..... 123/195 R

(58) Field of Classification Search ..... 74/603, 74/595, 596; 123/192.2, 192.1, 192.4, 197.1–197.4; 29/888.01–888.08; 403/242; *F02B 75/22; F02F 1/10, 7/00*
See application file for complete search history.

(56) References Cited

U.S. PATENT DOCUMENTS

| | | | | |
|---|---|---|---|---|
| 1,320,703 | A | 11/1919 | McClellan | |
| 2,549,482 | A * | 4/1951 | Kiekhaefer | 123/41.31 |
| 4,731,554 | A | 3/1988 | Hall et al. | |
| 4,796,352 | A | 1/1989 | Kawada et al. | |
| 6,161,512 | A * | 12/2000 | Beels Van Heemstede | 123/90.31 |
| 6,308,678 | B1 * | 10/2001 | Haas et al. | 123/192.1 |
| 6,819,020 | B2 | 11/2004 | Toya et al. | |
| 7,051,696 | B2 * | 5/2006 | Kanbe et al. | 123/195 R |
| 2008/0290748 | A1 | 11/2008 | Pfender et al. | |

* cited by examiner

*Primary Examiner* — Michael Cuff
*Assistant Examiner* — Keith Coleman
(74) *Attorney, Agent, or Firm* — Welsh Flaxman & Gitter LLC

(57) ABSTRACT

A crankcase and crankshaft combination wherein the crankshaft includes a first end having a cupped portion formed therein and the crankcase includes a housing section with an inner wall having an inwardly projecting cylindrical stub shaped and dimensioned for placement within the cupped portion.

7 Claims, 2 Drawing Sheets

CRANKCASE SIDEWALL FOR SUPPORTING A CRANKSHAFT

BACKGROUND OF THE INVENTION

1. Field of the Invention

The present invention relates to a crankcase of an engine, more particularly to the structure of a sidewall of a crankcase.

2. Description of the Related Art

The size and profile of current crankcases limits their ability for use in a variety of applications. The present invention overcomes these shortcomings by providing a low-profile crankcase adapted for use in a variety of applications in which size and profile are critical elements in the implementation of a crankcase.

SUMMARY OF THE INVENTION

It is, therefore, an object of the present invention to provide a crankcase and crankshaft combination including a crankshaft having a first end with a cupped portion formed therein and a crankcase. The crankcase includes a first crankcase housing section having an outer wall and an inner wall. The inner wall includes an inwardly projecting cylindrical stub shaped and dimensioned for placement within the cupped portion. The crankcase also includes a second crankcase housing section.

It is also an object of the present invention to provide a crankcase and crankshaft combination wherein the crankshaft includes a crank composed of a first crankshaft balancer and a second crankshaft balancer connected by a connecting pin, the cupped portion being formed in the first crankshaft balancer.

It is another object of the present invention to provide a crankcase and crankshaft combination wherein a bearing sleeve is positioned about the cylindrical stub for positioning between the cylindrical stub and the cupped portion.

It is a further object of the present invention to provide a crankcase and crankshaft combination including a front end bearing journal.

It is also an object of the present invention to provide a crankcase and crankshaft combination wherein the front end bearing journal includes a bearing shaft of the crankshaft and a bearing sleeve mounted upon the bearing shaft.

It is another object of the present invention to provide a crankcase and crankshaft combination wherein the inner wall of the first crankcase housing section of the crankcase follows a profile of the crankshaft, and the second crankcase housing section of the crankcase includes an outer wall and an inner wall, the inner wall of the second crankcase housing section following a profile of the crankshaft.

It is a further object of the present invention to provide a crankcase and crankshaft combination wherein the cupped portion includes a central longitudinal axis that substantially coincides with a central longitudinal axis of the crankshaft.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

Figure 1:
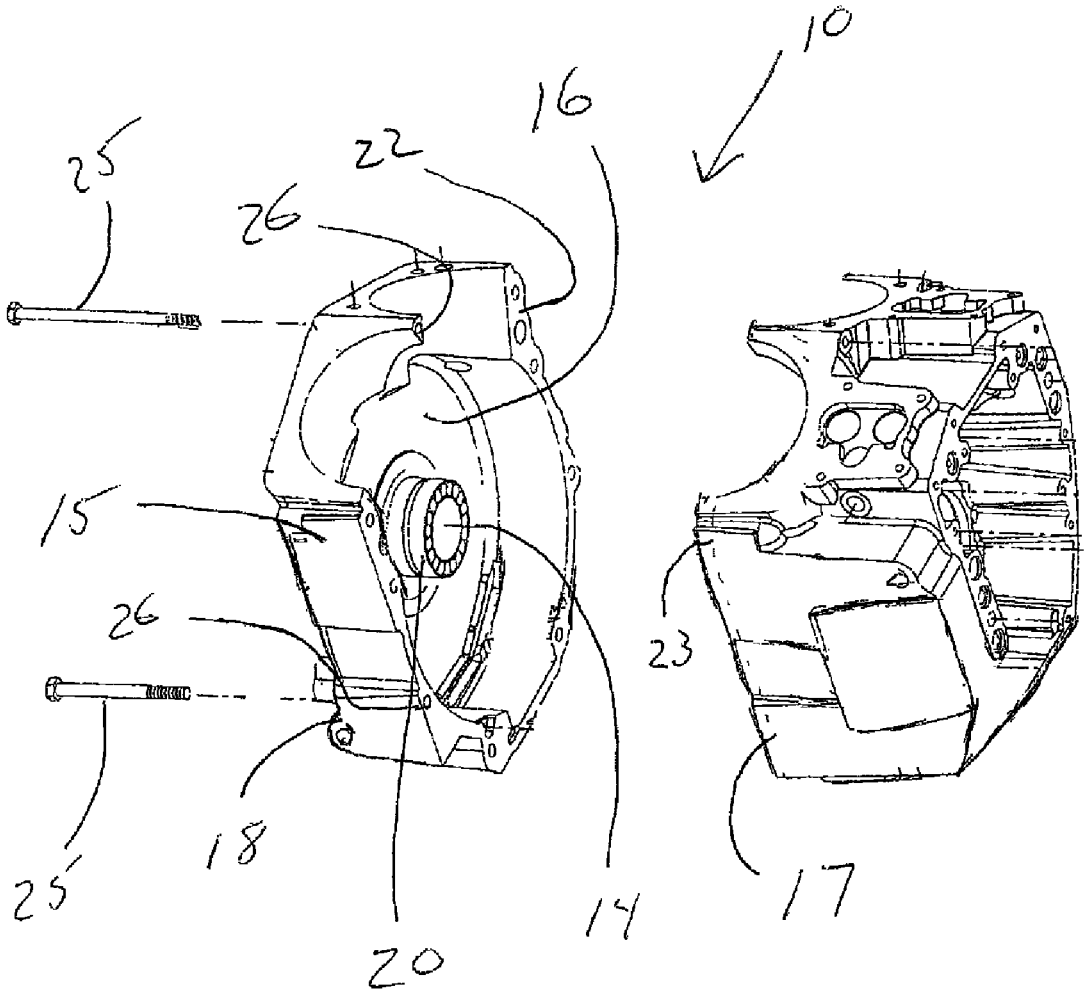
FIG. 1 is a perspective view of the crankcase of the present invention in an unassembled configuration.
Figure 2:
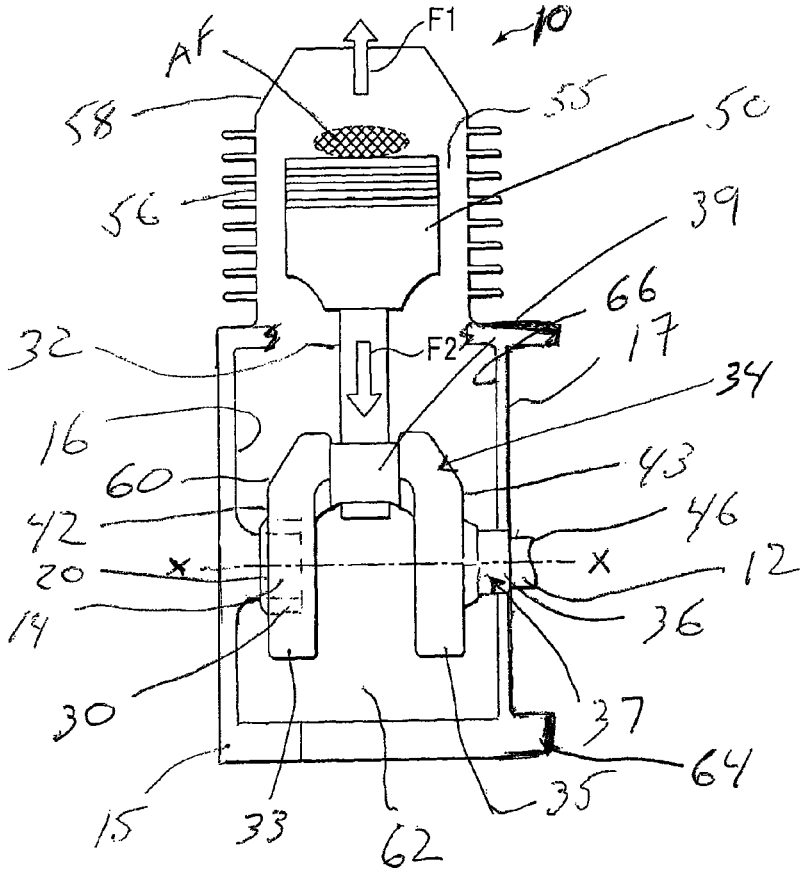
FIG. 2 is a view of the crankcase and an associated cylinder housing with a wall cut away to expose the components within and show the relationship of the crankcase to the crankshaft.
Figure 3:
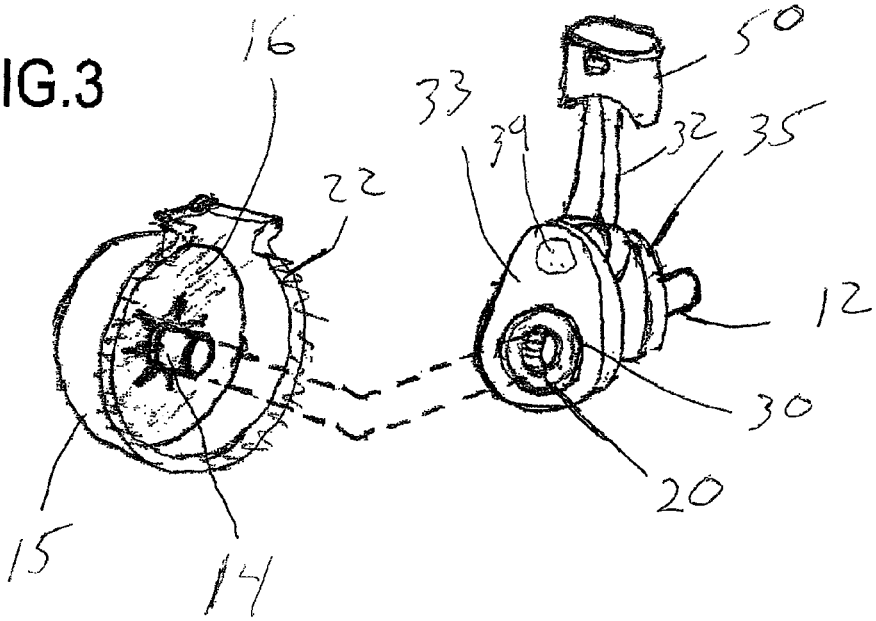
FIG. 3 is a perspective view of the first crankcase housing section being assembled to the crankshaft of the present invention.

In accordance with the present invention, and with reference to FIGS. 1 to 3, a crankcase 10 for a rotating crankshaft 12 is disclosed. Although the present crankcase is disclosed herein with reference to a motorcycle crankshaft, those skilled in the art will appreciate the concepts underlying the present invention may be applied to a variety of crankcase applications without departing from the spirit of the present invention.

The crankcase 10 of the present invention provides a low profile arrangement for supporting the rotating crankshaft 12. More particularly, the crankcase 10 includes a first crankcase housing section 15 and a second crankcase housing section 17. The first crankcase housing section 15 includes an inner wall 16 from which an integrally formed cylindrical stub 14 projects inwardly toward the second crankcase housing section 17.

The first or rear end 60 of the crankshaft 12 includes a cupped portion (or central cavity) 30 for receiving a bearing sleeve 20 positioned about the stub 14. As shown in FIG. 1 the bearing sleeve 20 is fitted onto and over the stub 14. The cupped portion 30 at the first end 60 of the crankshaft 12 is then fitted onto the bearing sleeve 20 for rotation about the stub 14. This arrangement provides for a crankcase having a housing section with an internally projecting crankshaft support stub which results in a lower profile crankcase.

As disclosed above, the crankcase 10 is composed of a first crankcase housing section 15 and a second crankcase housing section 17. The first and second crankcase housing sections 15, 17 are joined at a perimeter skirt 22 on the first crankcase housing section 15 and a perimeter skirt 23 on the second crankcase housing section 17 to form the crankcase 10 with a central cavity 62 therein. The first crankcase housing section 15 and the second crankcase housing section 17 are secured together to form a complete enclosure via bolts 25 running through bores 26 formed in the first crankcase housing section 15 and into mating threaded bores (not shown) in the skirt 23 of the second crankcase housing section 17. The crankcase 10 is preferably cast from a metal, such as aluminum, iron or an alloy.

Secured within the cavity 62 defined by crankcase 10 is the crankshaft 12, or the like. The crankshaft 12 includes a first end 60 which is connected to the stub 14 as discussed above. Extending from the first end 60 of the crankshaft 12, the crankshaft 12 is conventional in construction (with the exception of the cupped portion 30 at the first end 60 thereof) and includes a first crankshaft balancer 33, a connecting pin 39, a second crankshaft balancer 35, and a bearing shaft 36 extending to the second end (not shown) of the crankshaft. The crankshaft 12 is connected to a connecting rod 32 via the connecting pin 39 which in turn is connected to a piston 50.

As can be seen in FIG. 2 the crankshaft 12 is unconventional in that it does not include a rear main bearing journal. Instead, the crankcase 10 includes a stub 14 and a bearing sleeve 20 upon which the cupped portion 30 of the crankshaft 12 is mounted for rotation relative thereto. The front main bearing shaft 36 is supported by the second crankcase housing section 17 through which the crankshaft 12 extends.

The first crankcase housing section 15 of the crankcase 10 includes an outer wall 18 and an inner wall 16. The outer wall 18 is substantially convex and provides a protective cover for the crankshaft 12 and the other components housed therein. The inner wall 16 is concave and is shaped and dimensioned for rotationally supporting the crankshaft balancer 33 based upon the mounting of the cupped portion 30 upon the inwardly directed stub 14. The inner wall 16 of the first crankcase housing section 15 follows the profile of the first crankshaft balancer 33. Similarly, the second crankcase housing section 17 of the crankcase 10 includes an outer wall 64 and an inner wall 66. The outer wall 64 is substantially convex and provides a protective cover for the crankshaft 12 and the other components housed therein. The inner wall 66 is concave and is shaped and dimensioned for receipt of the second crankshaft balancer 35. The inner wall 66 of the second crankcase housing section 17 follows the profile of the second crankshaft balancer 35. By providing a first crankshaft balancer 33 which conforms to the inner wall 16 of the first crankcase housing section 15, a second crankshaft balancer 35 which conforms to the inner wall 66 of the second crankcase housing section 17, and mounting the first end 60 of the crankshaft 12 upon a stub 14 projecting inwardly from the inner wall 16 of the first crankcase housing section 15, a reduced profile is produced because the inner wall 16 is able to follow the contour of the crank 34 for minimizing the profile of the entire assembly and the length of the crankshaft is decreased.

As briefly discussed above, the crankshaft 12 is coupled to a motor piston 50, or other drive mechanism, via the connecting rod 32. The connecting rod 32 is rotationally secured to the connecting pin 39 in a conventional manner. As those skilled in the art will certainly appreciate, the interaction between the connecting rod 32 and the crankshaft 12 is traditional and ultimately relies upon the conversion of linear motion of the connecting rod 32 into rotary motion of the crankshaft 12 as noted by forces F1 and F2 caused by the explosion of the air and fuel AF in the cylinder 55 formed by cylinder head 56 and rocker cover 58.

The connecting pin 39, at its respective ends, is connected to first and second crankshaft balancers 33, 35 of the crankshaft 12 thereby forming what is commonly referred to as the crank 34. As such, the first crankshaft balancer 33 is provided, on its exterior side 42, with the cupped portion 30 shaped and dimensioned to receive the stub 14 and bearing sleeve 20. The second crankshaft balancer 35, on its exterior side 43, is provided with a front end bearing journal 37, composed of a bearing sleeve 68 of the second crankcase housing section 17 and the bearing shaft 36 of the crankshaft 12, such that the crankshaft 12 is rotationally mounted relative to the second crankcase housing section 17. Extending from the second crankcase housing section 17 is the front end 46 of crankshaft 12 which connects with the primary drive shaft (not shown) of the assembly to be driven by the present crankshaft 12.

The central cavity 30 discussed above is formed such that the central longitudinal axis of the central cavity 30 substantially coincides with the central longitudinal axis of the crankshaft 12, note axis x-x. The central cavity 30 of the crankshaft 12 is a concave recess shaped and dimensioned for receiving the stub 14 of the first crankcase housing section 15 and bearing sleeve 20. As such, the central cavity 30 interacts with the bearing sleeve 20 of the stub 14 allowing for unrestricted rotation of the crankshaft 12 relative to the crankcase housing.

As previously stated, this arrangement allows for space savings due to the elimination of seals and an outer cover on one end of the crankcase. The present crankcase also provides for weight savings and improved stiffness of the crankshaft due to reduced length and closer spacing of bearings. The features offer improvements over the prior art by enhancing cornering clearance and/or center of gravity of motorcycles. The present crankcase could also be applied in improving the overall weight and bulk of portable power tools, such as weed trimmers and chainsaws. It is further contemplated the present crankcase could be applied in the upgrading of existing "overhung crank" engines to "full crank" by only redesigning the crankshaft and crankcase endcap as opposed to the complete redesign thereof.

It is further contemplated the present invention may be fabricated using computer controlled machining techniques.

The present crankcase/shaft arrangement is suitable for use in conjunction with crankshafts, such as found in internal combustion engines, compressors and drive assemblies, and straight shafts, such as, electrical motors, transmissions and other drive assemblies. The arrangement allows for space savings, weight savings, improved stiffness, weight reduction, and no need for either a shaft seal or an outer casing cover.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A crankcase and crankshaft combination, comprising:

a crankshaft including a first end having a cupped portion, composed of a central cavity which is a concave recess, formed therein;

a crankcase comprising:

a first crankcase housing section including an outer wall and an inner wall including an inwardly projecting cylindrical stub positioned within the central recess of the cupped portion; and a second crankcase housing section.

2. The crankcase and crankshaft combination according to claim 1, wherein the crankshaft includes a crank composed of a first crankshaft balancer and a second crankshaft balancer connected by a connecting pin, the cupped portion being formed in the first crankshaft balancer.

3. The crankcase and crankshaft combination according to claim 1, wherein a bearing sleeve is fitted onto and over the cylindrical stub such that the bearing sleeve is positioned about the cylindrical stub and between the cylindrical stub and the cupped portion.

4. The crankcase and crankshaft combination according to claim 1, further including a front end bearing journal.

5. The crankcase and crankshaft combination according to claim 4, wherein the front end bearing journal includes a bearing shaft of the crankshaft and a bearing sleeve mounted upon the bearing shaft.

6. The crankcase and crankshaft combination according to claim 1, wherein the inner wall of the first crankcase housing section of the crankcase follows a profile of the crankshaft, and the second crankcase housing section of the crankcase includes an outer wall and an inner wall, the inner wall of the second crankcase housing section following a profile of the crankshaft.

7. The crankcase and crankshaft combination according to claim 1, wherein the cupped portion includes a central longitudinal axis that substantially coincides with a central longitudinal axis of the crankshaft.

* * * * *